US009540707B2

(12) United States Patent
Arvidsson et al.

(10) Patent No.: US 9,540,707 B2
(45) Date of Patent: Jan. 10, 2017

(54) IRON AND MOLYBDENUM CONTAINING AGGLOMERATES

(71) Applicant: AB Ferrolegeringar, Stockholm (SE)

(72) Inventors: Johan Arvidsson, Nyhamnsläge (SE); Dag Sjöberg, Stockholm (SE); Bo Zander, Strässa (SE)

(73) Assignee: AB Ferrolegeringar, Stockholm (SE)

( * ) Notice: Subject to any disclaimer, the term of this patent is extended or adjusted under 35 U.S.C. 154(b) by 18 days.

(21) Appl. No.: 14/287,669

(22) Filed: May 27, 2014

(65) Prior Publication Data

US 2014/0260799 A1 Sep. 18, 2014

Related U.S. Application Data

(63) Continuation-in-part of application No. 14/114,927, filed as application No. PCT/EP2012/073599 on Nov. 26, 2012, now abandoned.

(30) Foreign Application Priority Data

| | | |
|---|---|---|
| Nov. 25, 2011 | (EP) | 11190836 |
| Feb. 22, 2012 | (SE) | 1250162 |
| May 16, 2012 | (SE) | 1250503 |
| May 27, 2013 | (SE) | 1300383 |

(51) Int. Cl.

| | |
|---|---|
| ***C22C 30/00*** | (2006.01) |
| ***C22C 45/10*** | (2006.01) |
| ***C22B 4/06*** | (2006.01) |
| ***C22B 1/16*** | (2006.01) |

(Continued)

(52) U.S. Cl.
CPC . *C22B 1/16* (2013.01); *C22B 4/06* (2013.01); *C22C 27/04* (2013.01); *C22C 30/00* (2013.01); *C22C 35/00* (2013.01); *C22C 45/10* (2013.01)

(58) Field of Classification Search
CPC ..... C22C 30/00; C22C 45/10; C22B 4/06
See application file for complete search history.

(56) References Cited

U.S. PATENT DOCUMENTS

| | | | |
|---|---|---|---|
| 3,737,301 | A | 6/1973 | Chu |
| 3,865,573 | A | 2/1975 | Neumann et al. |
| 4,039,325 | A | 8/1977 | Buker |

(Continued)

FOREIGN PATENT DOCUMENTS

| | | |
|---|---|---|
| CN | 86106257 | 11/1987 |
| DE | 196 22 097 A1 | 12/1997 |

(Continued)

OTHER PUBLICATIONS

International Search Report dated Jan. 15, 2013 for International application No. PCT/EP2012/073599.

(Continued)

*Primary Examiner* — George Wyszomierski
*Assistant Examiner* — Tima M McGuthry Banks
(74) *Attorney, Agent, or Firm* — Morgan, Lewis & Bockius LLP

(57) ABSTRACT

Iron and molybdenum containing agglomerates and a process for producing the agglomerates are disclosed. A green agglomerate is produced from mixing an iron containing powder, a molybdenum oxide powder, and a carbonaceous powder. The green agglomerates can be reduced at a temperature in the range of 400-1500° C.

17 Claims, 6 Drawing Sheets

(51) Int. Cl.
*C22C 27/04* (2006.01)
*C22C 35/00* (2006.01)

(56) References Cited

U.S. PATENT DOCUMENTS

| | | | |
|---|---|---|---|
| 4,045,216 | A | 8/1977 | Meyer et al. |
| 2003/0106395 | A1 | 6/2003 | Leitner |

FOREIGN PATENT DOCUMENTS

| | | | | |
|---|---|---|---|---|
| GB | 1549147 | A | * | 8/1979 |
| GB | 2173216 | A | * | 10/1986 |

OTHER PUBLICATIONS

Written Opinion of the International Searching Authority for International application No. PCT/EP2012/073599.

* cited by examiner

IRON AND MOLYBDENUM CONTAINING AGGLOMERATES

TECHNICAL FIELD

The present invention relates to a process for producing iron and molybdenum containing agglomerates and agglomerates produced by the process.

BACKGROUND

Ferromolybdenum is an iron molybdenum alloy normally having a molybdenum content of 60-80% by weight.

In most commercial applications ferromolybdenum is produced from molybdenum trioxide ($MoO_3$) by a carbothermic reduction, an aluminothermic reduction, or a silicothermic reduction. The carbothermic process produces a high carbon ferromolybdenum, while the latter two produces a low carbon ferromolybdenum. Low carbon ferromolybdenum is more common than the high carbon alloy. Lumps of ferromolybdenum produced by these methods normally have densities around 9 g/cm$^3$. Dissolving the lumps in the steel melt can be difficult due to the high melting point of the lumps, for instance the commercial grade FeMo70 has a melting point of 1950° C., and since the temperature of the steel melt is considerably lower, dissolution of the ferromolybdenum is mainly affected by diffusion processes, which prolong the dissolution time of the ferromolybdenum. Another factor is the high cost of raw materials in the aluminothermic reduction and silicothermic reductions. Furthermore, around 2% of the Mo can be lost in the slag in these processes.

OBJECTS OF THE INVENTION

It is an object of the invention to provide a novel iron and molybdenum containing material suitable for molybdenum addition in melting industries e.g. steel, foundry and superalloy industry, and a process for producing such material in a comparably cost efficient manner.

A further object is to provide a novel iron and molybdenum containing material that has a comparably quick dissolving time in a steel melt, and a process for producing such material in a comparably cost efficient manner.

A further object is to provide a novel iron and molybdenum containing material low in carbon and high in Mo, and a process for producing such material in a comparably cost efficient manner.

A further object is to provide a material that can be easily handled when added to the melt, and a process for producing such material in a comparably cost efficient manner

SUMMARY OF THE INVENTION

At least one of the above mentioned objects is at least to some extent achieved by a process for producing an iron and molybdenum containing agglomerates including the steps of:

providing a mixture by mixing an iron containing powder, a molybdenum oxide powder, a carbonaceous powder, and a liquid;

agglomerating the mixture to provide a plurality of green agglomerates.

In the present application the term "green" is used for raw or non-reduced agglomerates.

In the present applications, the term agglomerates includes pellets and compacts. The term compacts includes briquettes, filter cakes, compacted sheets, and other shapes of compacted agglomerates.

In some embodiments drying the green agglomerates to reduce the moisture content to less than 10% by weight. The moisture content is defined as water present in the green pellets apart from water of crystallization. The moisture content can be determined by a LOD (loss on drying) analysis in accordance to ASTM D2216-10. By drying the green agglomerates to a moisture content less than 10% by weight, the risk of cracking due to quick vaporisation of the liquid, when heated at high temperatures, is minimised. Preferably the green agglomerates are dried to have a moisture content less than 5% by weight, more preferably less than 3% by weight.

The iron and molybdenum containing green agglomerates may have a dry matter composition in weight-% of:

1-25 Fe,
15-40 O,
5-25 C,
less than 15 of other elements, and
balance at least 30 Mo.

The non-reduced green agglomerates may be used as a substitute for traditionally manufactured ferromolybdenum alloys or even as a substitute for molybdenum oxide, when alloying the melt in industrial production. The iron- and/or molybdenum containing green agglomerates can be produced at lower costs than standard grades of ferromolybdenum.

The green agglomerates may be reduced at a temperature in the range of 800-1500° C.

The reduced iron and molybdenum containing agglomerates may have geometric density less than 4.0 g/cm$^3$ a composition in weight % of:

1-30 Fe;
less than 30 O;
less than 20 C;
less than 15 of other elements; and
balance at least 40 Mo.

The reduced agglomerates can substitute for traditionally manufactured ferromolybdenum alloys, when alloying with molybdenum in melting practices. The iron- and/or molybdenum containing agglomerates can be produced at lower costs than standard grades of ferromolybdenum. As shown in the example below, the iron and molybdenum containing agglomerates dissolve quicker than standard grades of ferromolybdenum. Depending on the reduction time, the relative amount of carbon in relation to the amount of reducible oxides, and the reduction temperature—the oxygen content in the agglomerates can be partially or fully reduced.

Further embodiments will be described in the description of the invention.

BRIEF DESCRIPTIONS OF THE DRAWINGS

Figure 5:
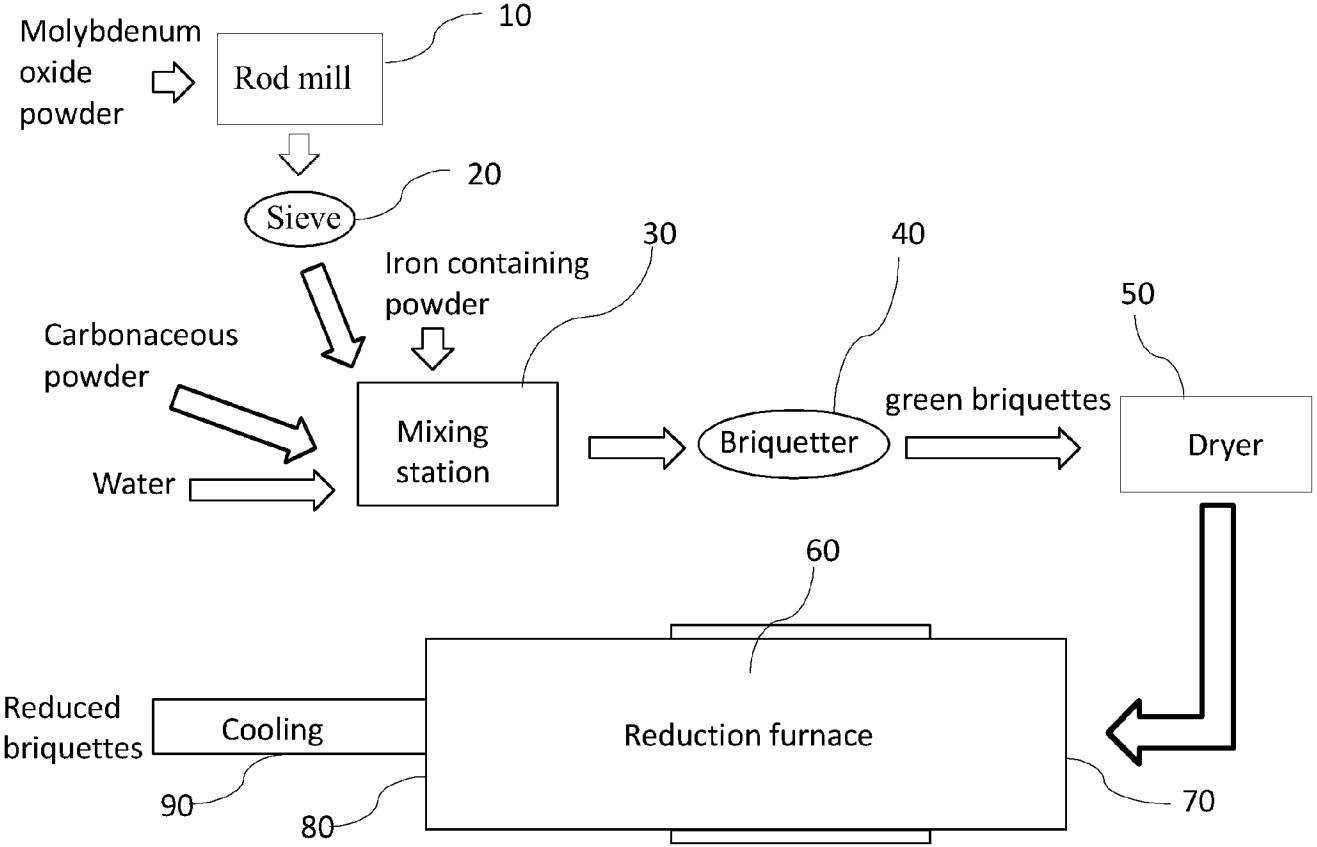

FIG. 5 schematic overview of the process of producing iron and molybdenum containing briquettes according to an embodiment.

Figure 6:
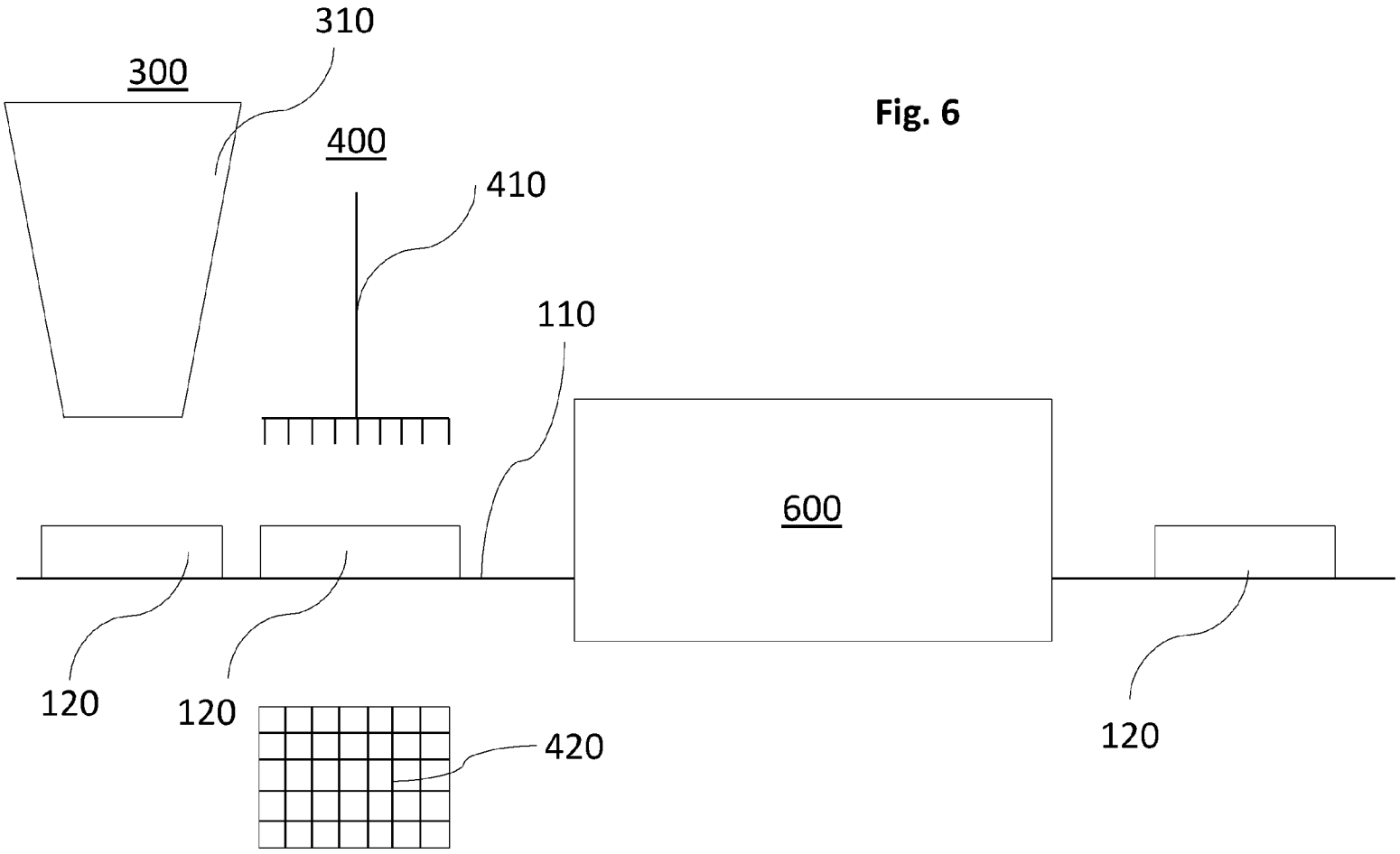

FIG. 6 schematic overview of the process of producing iron and molybdenum containing briquettes according to an embodiment.

DESCRIPTION OF THE INVENTION

The invention will now be described in relation in more detail and with reference to the figures.

Figure 1:
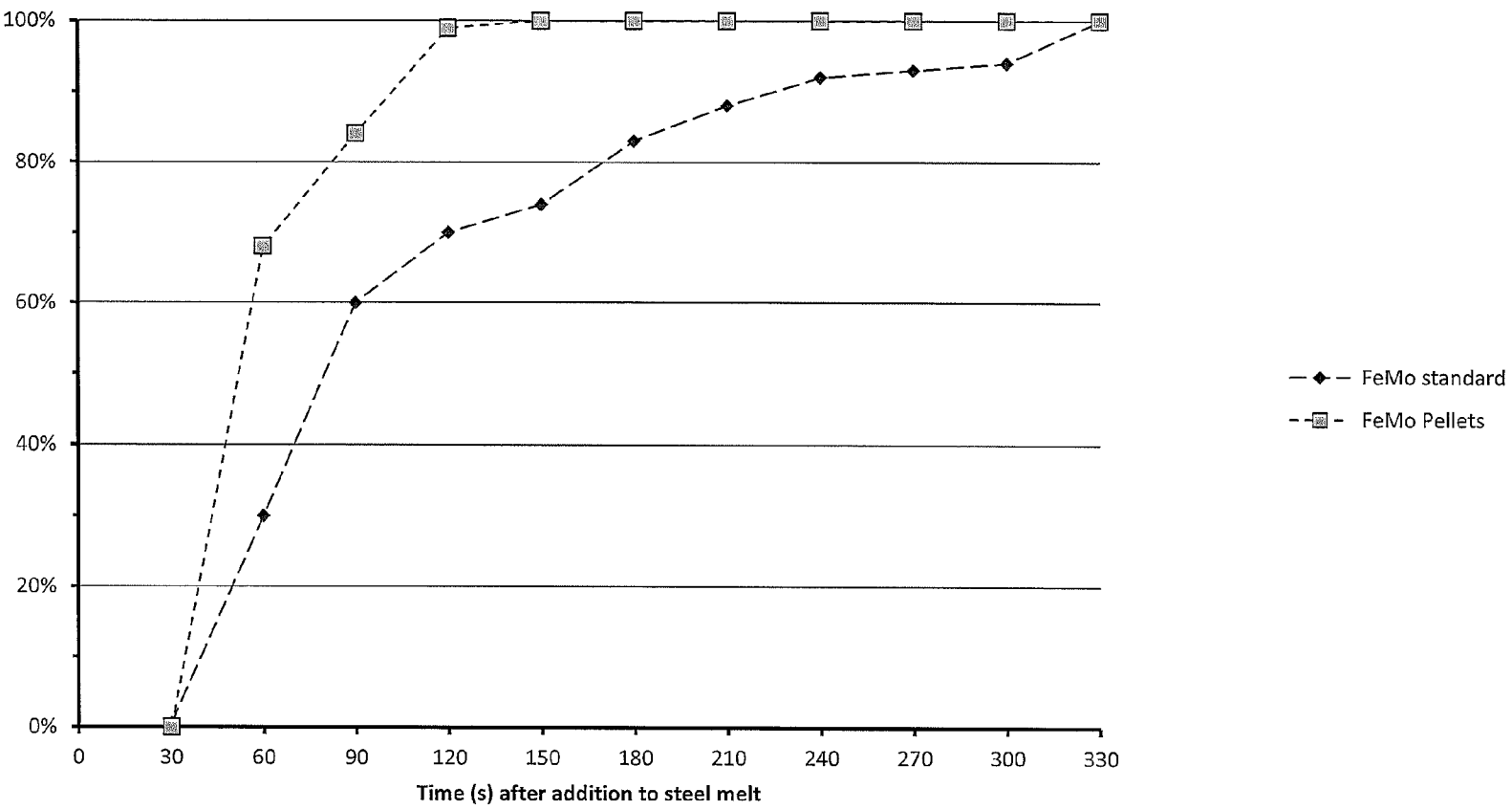
FIG. 1 shows the dissolution rate of the iron and molybdenum containing pellets of the invention as compared to a reference grade of solid ferromolybdenum.

FIG. 1 reveals that the dissolution time for the inventive material is much shorter than that of the reference grade.

Figure 2:
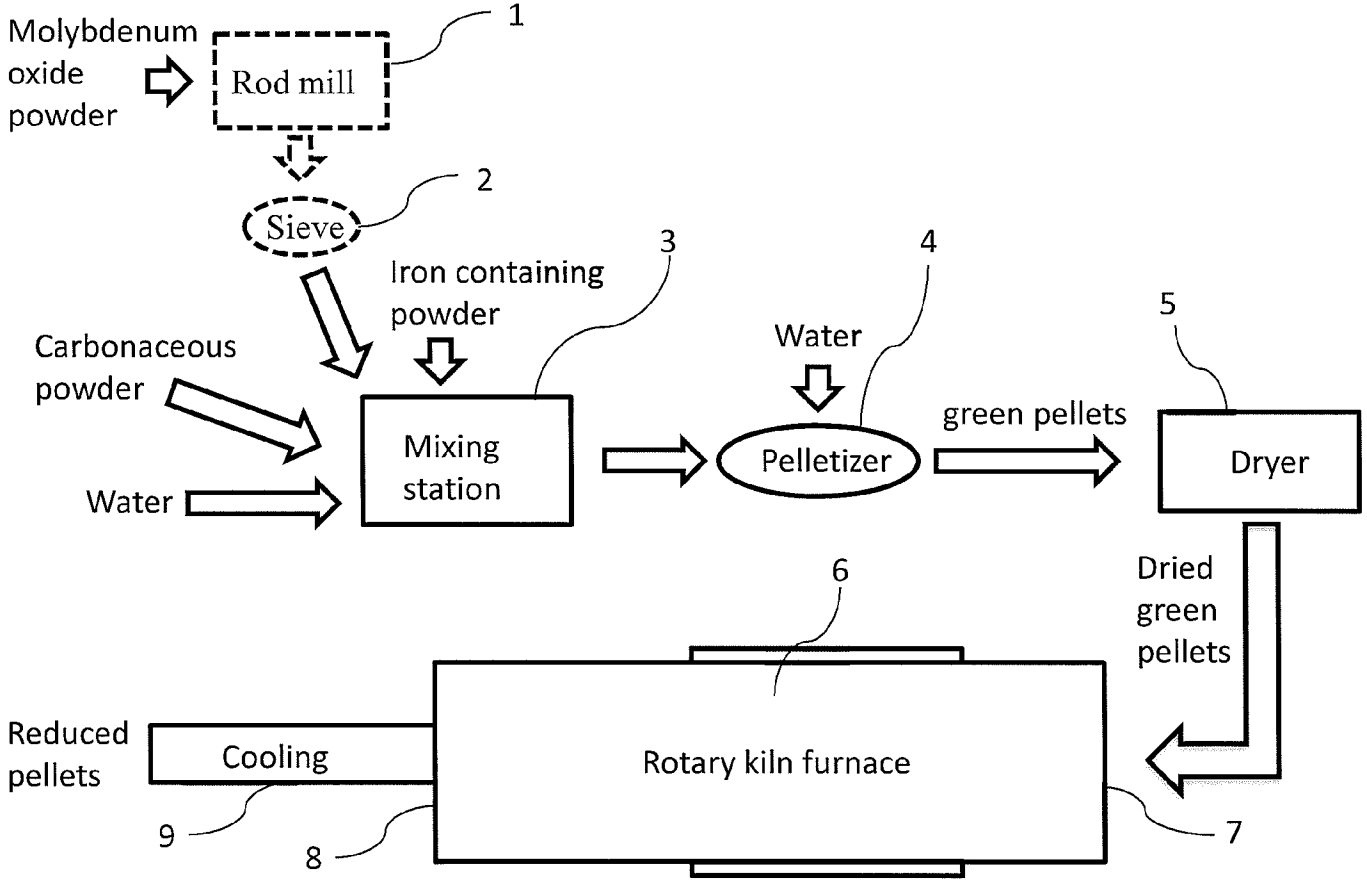
FIG. 2 is a schematic overview of the process of producing iron and molybdenum containing pellets according to an embodiment.

FIG. 2 shows a schematic overview of the process of producing iron and molybdenum containing pellets according to the invention.

In the mixing station 3, a powder mixture is prepared by mixing an iron containing powder, a carbonaceous powder, and a molybdenum oxide powder.

Typically iron powder is added in amounts of 1-10% by weight, however, up to 25% by weight of Fe may be added. Iron powder is mainly used to strengthen the pellets (e.g. acts as a binder) but may be altered to balance the desired amount of Fe and Mo in the final product. Molybdenum oxide powder is typically added in amounts of 70-90% by weight.

Preferably, the amount of carbonaceous powder is chosen to enable reduction of the oxygen content to 0-10% by weight, while keeping the carbon content after full reduction to lower than 5% by weight. Preferably the carbonaceous powder is balanced so that most, preferably all, of the molybdenum oxide can be reduced to Mo, e.g. $MoO_x$, where $x \leq 0.5$. Thereby the majority of remaining oxides after reduction are oxides that are difficult to reduce with carbon. Examples of oxides that are difficult to reduce with carbon are $Al_2O_3$, $SiO_2$, MgO, CaO. As described below, the green pellets produced from the powder mixture can be reduced in a reduction furnace 6. Alternatively the non-reduced green pellets can be used as alloying additive in iron and steel making.

The powders may be mixed in a dry condition, i.e. without adding liquid during mixing, but are preferably mixed in a wet condition by adding liquid, preferably water, in the mixing station 3. Preferably 5-15% by weight of water is added during mixing. By adding water during mixing dusting problems are minimized.

Before being added to the mixing station 3, the molybdenum oxide powder may be milled in the rod mill 1. Of course other mills, grinders, or crushers may be used to disintegrate the molybdenum oxide into smaller particles. Furthermore, the iron containing powder and/or the carbonaceous powder may also be disintegrated into smaller particles by grinding and/or milling and/or crushing. The ground and/or milled and/or crushed molybdenum oxide particles may be sieved in a sieve 2 to provide a desired particle distribution. Naturally, sieving can also be applied to the iron containing powder and/or the carbonaceous powder.

In one embodiment the molybdenum oxide powder and the carbonaceous powder are mixed and ground together and thereafter the iron containing powder is added and mixed with the molybdenum oxide powder and the carbonaceous powder. However, any combination of mixing order may be executed.

The mixing in the mixing station 3 can be executed batchwise or continuously.

Optionally, binders and/or slag formers can be added when mixing. The optional binders may be organic or inorganic binders. The binders may e.g. be a carbon containing binders partially replacing the carbonaceous powder. Other binders may e.g. be bentonite and/or dextrin and/or sodium silicate and/or lime. The optional slag former may be limestone, dolomite, and/or olivine. The total amount of optional binders and/or optional slag forms can be 1-10% by weight, more preferably less than 5 wt %, by dry weight of the mixture. The binders are optional since the iron containing powder can provide pellets that are sufficiently strong (e.g. at least 200 N/pellet after drying).

From the mixing station 3 the prepared powder mixture is transferred to a pelletizer 4. In the pelletizer 4 the powder mixture is pelletized, providing a plurality of green pellets. If the powders were dry mixed in the mixing station 3, liquid is supplied when pelletizing. If the powders were wet mixed in the mixing station 3 additional liquid is optionally supplied when pelletizing. The pelletizer 4 is preferably a disc pelletizer or a rotary drum pelletizer.

In total, during mixing and pelletizing, the amount of added liquid is around 5-25% by weight of the mixture, more preferably 10-20 wt %, e.g. adding 10 wt % during mixing and 5 wt % during pelletizing.

The pellets produced from the pelletizer 4 are here referred to as green pellets. Directly after the pelletizer 4 the green pellets typically have a compression strength around 10-20 N/pellet. The shape of the green pellet is typically spherical, spheroidal, or ellipsoidal.

To reduce the moisture content the green pellets are transferred to a dryer 5, e.g. a rotary dryer. Many other kinds of industrial dryers can of course be used. Vapour is preferably removed by a gas steam or by vacuum. The pellets are dried until desired moisture content has been reached. Preferably the green pellets are dried to a moisture content less than 10% by weight, more preferably less than 5% by weight, most preferably less than 3% by weight. Preferably the green pellets are dried at a temperature in the range of 50-250° C., more preferably 80-200° C., most preferably 100-150° C. For improved process economy, drying time is preferably in the range of 10-120 minutes, more preferably 20-60 minutes. But longer drying times are of course viable. Furthermore the green pellets may also be dried without active heating, e.g. in ambient air temperature. After drying the green pellets have a maximum moisture content of 10% by weight. Hereafter referred to as dried green pellets.

Reducing the moisture content has several advantages. One advantage is that the risk of cracking in the reduction furnace 6 is minimised. Green pellets may crack due to quick vaporisation of the remaining liquid in the pellets when heated at high temperatures. Additionally, after drying, the dried green pellets are surprisingly strong and they are therefore not required to be compacted at all before, during or after reduction. In the Example 1 below the dried green pellets have compression strength around 450-500 N/pellet. The iron containing powder act as a binding agent when mixed in wet condition, and for this reason there is also no need to have additional binders. Also the carbonaceous powder contributes to the strength of pellets. Therefore it is an optional step to add a binder during mixing (with the term binder we exclude the iron containing powder and the carbonaceous powder). The dried green pellets can have compression strength in the range of 200-1000 N/pellet, preferably the compressions strength is 300-800 N/pellet. This compression strength is sufficient for effective handling of the pellets including reduction in a rotary kiln. Stronger pellets may be produced by adding binders, thus enabling a compression strength above 1000 N/pellet if such would be desired.

After the dryer 5, the dried green can be used as alloying additive in iron and steel making. The strength and the shape of the green pellets make them easy to transport and handle with low shredding losses. Unexpectedly it has been found that dried green pellets used as an alloying additive did not result in any noticeable molybdenum losses.

The dried green pellets may be partially or fully reduced in a reduction furnace, such as a rotary kiln furnace 6. In the rotary kiln furnace 6 the green pellets are heat treated at a furnace temperature in the range of 400-1500° C.

Optionally the dried green pellets are heat treated, in a step d), at a temperature in the range of 400-800° C., preferably lower than 700° C., during at least 20 minutes. Preferably, the optional heat treating step d) is performed not more than 2 hours, preferably less than 1 hour. By having a heat treatment step at lower temperatures molybdenum trioxide can be reduced to molybdenum dioxide. This step can be employed as a pre-reduction step prior to the reduction step e) or as a main reduction step when producing partially reduced pellets. The optional heat treating step can be performed in the same furnace as the reduction step e) (see below). Alternatively it would be possible to transfer the partially reduced pellets to another furnace for the reduction step e).

In a step e), preferably reducing the pellets derived from step c) or d) at a temperature in the range of 800-1500° C., preferably 800-1350° C., more preferably 1000-1200° C., preferably during at least 10 minutes, and may be at least 20 minutes, or even at least 30 minutes. By monitoring the formation of $CO/CO_2$ it can be determined when the reduction process is finished. Preferably the reduction time in step e) is at most 10 hours, preferably at most 2 hours, more preferably at most 1 hour. Depending on the reduction time, the reduction temperature, and the relation between carbon and reducible oxides in the pellets; the reducible oxides of the pellets can be partially or fully reduced.

Unexpectedly it has been found that dried green pellets can be reduced at high temperatures without noticeable sublimation losses of $MoO_3$. Accordingly the claimed process results in a simplified process resulting in improved yield and higher Mo content in the end product. I.e. there is no need to perform a pre-reduction step d) prior to step e), hence the range 400-800° C. may be quickly passed when raising the temperature to the range 800-1500° C.

During the reduction CO and $CO_2$ can form from reactions with the carbon source and the reducible oxides in the pellets. Additionally remaining moisture may vaporise. The reduction time can be optimised by measuring the formation of CO and $CO_2$; in particular CO since CO2 is mainly formed during the first minutes of reduction where after CO formation is dominating until the carbon source is consumed or all reducible oxides have been reduced.

The reduction reactions are endothermic and require heat. Preferably heat is generated by heating means not affecting the atmosphere within the furnace, more preferably the heat is generated by electrical heating.

Suitable furnace types for the optional heat treatment step and the reduction step are for example rotary kilns, rotary heart furnaces, shaft furnaces, grate kilns, travelling grate kilns, tunnel furnaces or batch furnaces. Other kinds of furnaces used in solid state direct reduction of metal oxides may also be employed. For instance belt furnaces and walking beam furnaces.

In a preferred embodiment a rotary kiln is used to reduce the pellets. In a rotary kiln furnace the green pellets from step c) are fed to a rotary kiln rotating on a slightly inclined horizontal axis, and propagated from an inlet of the kiln towards an outlet of the kiln, as the kiln is rotated about its axis.

The atmosphere within the furnace 6 is preferably controlled by supplying an inert or a reducing gas, preferably a weakly reducing gas, e.g. $H_2/N_2$ (5:95 by vol.), at one end of the furnace and evacuating gases (e.g. reaction gases (e.g. CO, $CO_2$, and $H_2O$) and the supplied gas) at the opposite end, more preferably, supplying the inert or reducing gas counter current at an outlet side 8 of the furnace 6, and evacuating gases at an inlet side 7 of the furnace 6. I.e. the inert or reducing gas is preferably supplied counter flow. The gas supplied may include argon, $N_2$, $H_2$, CO, CO2 or any mixture of them. For instance H2/N2 having relations such as 5:95, 20:80, 40:60, 80:20, and 95:5 by vol. In one embodiment the atmosphere comprises 20-60 vol % of $H_2$ and balance $N_2$. Such atmosphere may reduce $N_2$ uptake, compared to e.g. $H_2/N_2$ (5:95), and it may increase the density of the reduced pellets. The atmosphere may also be supplied with CO, e.g. from burning natural gas. Of course, other gas mixes being inert or reducing may be supplied to the furnace.

Preferably the furnace operates at pressure in the range of 0.1-5 atm, preferably 0.8-2 atm, more preferably at a pressure in the range of 1.0-1.5 atm, most preferably 1.05-1.2 atm.

In a possible embodiment, a first section of the kiln provides a temperature zone in the range of 400-800° C. (a pre-heating zone) in which 50-100 wt % of $MoO_3$ in the green pellets is reduced by the carbonaceous powder to $MoO_2$, and a second section downstream the first section provides a temperature zone in the range of 800-1500° C. in which 50-100 wt % of remaining molybdenum oxides are reduced by the remaining carbonaceous powder to Mo.

In an alternative embodiment, in order to reduce the amount of required external heat, oxygen gas or air can be provided in the pre-heating zone to react with the formed carbon monoxide to form carbon dioxide gas. If air is used the nitrogen uptake of the pellets may increase. Using oxygen the nitrogen uptake during the heating and the reduction step can be minimised.

At the outlet 8 of the reduction furnace the pellets are transferred to a cooling section 9, providing a step f): cooling the pellets from step d) or e) in a non-oxidising atmosphere (e.g. reducing or inert) to a temperature below 200° C. to avoid re-oxidation of the pellets, more preferably below 150° C. in an inert atmosphere. The atmosphere may e.g. be a 95 vol-% $N_2$ and 5 vol. % $H_2$ atmosphere. If it is desirable to have very low levels of nitrogen in the pellets, the pellets may be cooled in a nitrogen free atmosphere such as for example an argon gas atmosphere.

The produced pellets may further be subjected to additional process steps including:

- crushing and/or grinding the pellets;
- sieving the crushed and/or ground pellets
- hot briquetting at a temperature in the range of 250-1000° C., preferably 400-800° C., and more preferably between two counter-rotating rollers
- agglomerating the pellets to pellet agglomerates comprising 2-300 pellets.

FIG. 5 is a schematic overview of the process of producing iron and molybdenum containing briquettes according to the invention. In the mixing station 30, a powder mixture is prepared by mixing an iron containing powder, a carbonaceous powder, a molybdenum oxide powder, and water. The mixing in the mixing station 30 can be executed batchwise or continuously.

Before being added to the mixing station 30, the molybdenum oxide powder may be milled in the rod mill 10. Of course other mills, grinders, or crushers may be used to disintegrate the molybdenum oxide into smaller particles. Furthermore, the iron containing powder and/or the carbonaceous powder may also be disintegrated into smaller particles by grinding and/or milling and/or crushing.

The ground and/or milled and/or crushed molybdenum oxide particles may be sieved in a sieve 20 to provide a desired particle distribution. Naturally, sieving can also be applied to the iron containing powder and/or the carbonaceous powder.

In one embodiment the molybdenum oxide powder and the carbonaceous powder are mixed and ground together and thereafter the iron containing powder is added and mixed with the molybdenum oxide powder and the carbonaceous powder. However, any combination of mixing order may be executed.

The molybdenum oxide powder, iron containing powder, and the carbonaceous powder are each described under separate headline below. The amount of added powders are described under the headline Iron and molybdenum containing green compacts.

Optionally, lubricants and/or binders and/or slag formers can be added when mixing. The optional binders may be organic or inorganic binders. The binders may e.g. be a carbon containing binders partially replacing the carbonaceous powder. Other binders may e.g. be bentonite and/or dextrin and/or sodium silicate and/or lime. Gelatin may also be used. The optional slag former may be limestone, dolomite, and/or olivine. The total amount of optional lubricants and/or binders and/or optional slag formers can be 0.1-10% by weight of the dry matter content of the mixture, more preferably less than 5 wt %. It may be in the range of 1-10% by weight. The binders are optional since the green briquettes by the water and iron addition becomes sufficiently strong to be reduced in the reduction furnace without severely cracking. If added the lubricant is preferably added in amounts of 0.1-2% of the dry matter content of the mixture, e.g. about 0.5-1% by weight. The lubricant can e.g. be zinc stearate. However, other lubricants that are used in powder metallurgy may be added.

Liquid, preferably water, is preferably added in amounts of 1-10% by weight of the dry matter content of the mixture, preferably 2-7% by weight. In some embodiments 2-5% by weight.

From the mixing station 30 the prepared powder mixture is transferred to a briquetting machine 40. In briquetting machine 40 the powder mixture is briquetted to provide a plurality of green briquettes.

Preferably the briquetting machine 40 is a roller press. However, other kinds of briquetting machines 40 can be used including but not limited to: mechanical piston presses, hydraulic presses, screw presses, briquette extruders. Furthermore the briquetting machine 4 may be substituted for other machines capable of compacting the mixture. For instance but not limited to; filter cakes may be produced in a filter press, flakes or sheets may be produced between two counter rotating rollers.

In one embodiment the powder mixture is compacted at a comparably low pressure. The lower limit of the compacting pressure may be as low as 20 kg/cm$^2$, but is typically at least 50 kg/cm$^2$. Preferably the compacting pressure is in the range of 80-1000 kg/cm$^2$, more preferably 100-500 kg/cm$^2$. The low compacting pressure has been found out to improve the quality of the produced green compacts.

In one embodiment a briquetting machines operates at higher pressures, e.g. in the range 1000-10000 kg/cm$^2$. Higher pressure can be used to increase the geometric density of green briquettes.

The green briquettes produced from the powder mixture are preferably reduced in a reduction furnace 60. Alternatively the non-reduced green briquettes can be used as alloying additive in iron and steel making.

Optionally the green briquettes are dried in a dryer 50 before being transferred to the reduction furnace 60. Many different kinds of industrial dryers can be used. The briquettes may also be dried without active heating, e.g. in ambient air temperature. In a dryer vapour may be removed by a gas steam or by vacuum. The green briquettes can be dried until desired moisture content has been reached. The green briquettes may be dried to moisture content less than 10% by weight, more preferably less than 5% by weight, most preferably less than 3% by weight. The green briquettes may be dried at a temperature in the range of 50-250° C., more preferably 80-200° C., most preferably 100-150° C. For improved process economy, drying time is preferably in the range of 10-120 minutes, more preferably 20-60 minutes. But longer drying times are of course viable. The moisture content is defined as water present in the green briquettes apart from water of crystallization. The moisture content can be determined by a LOD (loss on drying) analysis in accordance to ASTM D2216-10.

The green briquettes are preferably reduced in a reduction furnace 60. The reduction furnace is preferably a continuous furnace but may also be a batch furnace. The continuous furnace 6 having an inlet 7 and outlet 8, and the briquettes are conveyed during reduction from the inlet 7 to the outlet 8. In a preferred embodiment a belt furnace is used. Of course other furnace types may be used, for instance a walking beam furnace.

The green briquettes are reduced at a temperature in the range of 800-1500° C., preferably 800-1350° C. In some embodiments 1000-1200° C. The reduction time at least 10 minutes, preferably reducing during at least 20 minutes. In some embodiments during at least 30 minutes. By monitoring the formation of $CO/CO_2$ it can be determined when the reduction process is finished. Preferably the reduction time is at most 10 hours, preferably at most 2 hours, more preferably at most 1 hour. Depending on the reduction time, the reduction temperature, and the relation between carbon and reducible oxides in the briquettes; the reducible oxides of the briquettes can be partially or fully reduced.

Optionally the green briquettes are heat treated at a lower temperature before reduction. The green briquettes may be heat treated at a temperature in the range of 200-800° C., more preferably 400-700° C. Preferably, the optional heat treating at lower temperature is performed from 10 minutes to less than 2 hours, preferably less than 1 hour. By heat-treating at lower temperatures the optional lubricant can be burned off in a controlled manner. In addition molybdenum trioxide may be reduced to molybdenum dioxide. This may be employed as a pre-reduction step prior to the reduction described in the previous paragraph or when producing partially reduced briquettes. The optional heat treating at 200-800° C., can be performed in the same furnace as the reduction. The optional heat treating and optional drying may also be combined.

Unexpectedly it has been found that briquettes can be reduced at high temperatures without noticeable sublimation losses of $MoO_3$. Accordingly the claimed process results in a simplified process resulting in improved yield and higher Mo content in the end product. I.e. there is no need to perform a pre-reduction in regards to sublimation losses of $MoO_3$.

During the reduction CO and $CO_2$ can form from reactions with the carbon source and the reducible oxides in the briquettes. Additionally remaining moisture may vaporise. The reduction time can be optimised by measuring the formation of CO and $CO_2$; in particular CO since $CO_2$ is mainly formed during the first minutes of reduction where after CO formation is dominating until the carbon source is consumed or all reducible oxides have been reduced.

The reduction reactions are endothermic and require heat. Preferably heat is generated by heating means not affecting the atmosphere within the furnace, more preferably the heat is generated by electrical heating.

The atmosphere within the furnace 60 is preferably controlled by supplying an inert or a reducing gas, preferably a weakly reducing gas, at one end of the furnace and evacuating gases (e.g. reaction gases (e.g. CO, $CO_2$, and $H_2O$) and the supplied gas) at the opposite end, more preferably, supplying the inert or reducing gas counter current at an outlet side 80 of the furnace 60, and evacuating gases at an inlet side 70 of the furnace 60. I.e. the inert or reducing gas is preferably supplied counter flow. The gas supplied may include argon, $N_2$, $H_2$, CO, CO2 or any mixture of them. For instance H2/N2 having relations such as 5:95, 20:80, 40:60, 80:20, and 95:5 by vol. In one embodiment the atmosphere comprises 20-60 vol % of $H_2$ and balance $N_2$. Such atmosphere may reduce $N_2$ uptake, compared to e.g. $H_2/N_2$ (5:95), and it may increase the density of the reduced pellets. The atmosphere may also be supplied with CO, e.g. from burning natural gas. Of course, other gas mixes being inert or reducing may be supplied to the furnace.

Preferably the furnace operates at pressure in the range of 0.1-5 atm, preferably 0.8-2 atm, more preferably at a pressure in the range of 1.0-1.5 atm, most preferably 1.05-1.2 atm.

At the outlet 80 of the reduction furnace the briquettes are transferred to a cooling section 90, for cooling the briquettes in a non-oxidising atmosphere (e.g. reducing or inert) to a temperature below 200° C. to avoid re-oxidation of the briquettes, more preferably below 150° C. in an inert atmosphere. The atmosphere may e.g. be argon, $N_2$, $H_2$, or any mixture of $H_2/N_2$ (e.g. 5:95 by vol.). Other atmospheres may also be employed. If it is desirable to have very low levels of nitrogen in the briquettes, the briquettes may be cooled in a nitrogen free atmosphere such as for example an argon gas atmosphere.

FIG. 6 shows a method how to produce briquettes. In a mixing station 300 a powder mixture is prepared by mixing an iron containing powder, a carbonaceous powder, a molybdenum oxide powder, and water in a blender 300. A convening belt 110 conveys a tray 120 to the mixing station 300. In the mixing station 300 the tray 120 is filled with mixture from the blender 310. The tray 120 is thereafter conveyed to a briquetting station 400 and at the same time another tray 120 is conveyed to the mixing station 300 to be filled with mixture from the blender 310. In the briquetting station 400 the mixture on the tray is stamped by a meshed stamp 410 forming a set of green briquettes. The pattern seen is indicated by reference number 420. The tray 120 holding the green briquettes thereafter continues to a reduction furnace 600, here schematically shown as a belt furnace. Of course other furnace types may be used, for instance walking beam furnaces. Optionally a drying station may be positioned between the briquetting station and the reduction furnace 600.

Molybdenum Oxide Powder

The molybdenum oxide powder is preferably a molybdenum trioxide powder. The powder may also be a molybdenum dioxide powder or a mix of molybdenum trioxide powder and molybdenum dioxide powders.

The molybdenum powder should include 50-80% of Mo, the remaining elements being oxygen and impurities. The purer the grade of molybdenum oxide is, the purer the iron and molybdenum containing pellets can be made. However, purer grades of $MoO_3$ are on the other hand more expensive.

In a preferred embodiment technical grade $MoO_3$ is used. Such powders are less costly than purer grades of $MoO_3$ and may contain oxides that are difficult to reduce in solid state reduction with carbon. Examples of such oxides are e.g. $Al_2O_3$, $SiO_2$, and MgO. Fortunately these oxides can easily be removed to the slag phase when alloying in steel melts and they can therefore be allowed in the product.

Preferably at least 90% by weight of the particles of the molybdenum oxide powder pass through a test sieve having nominal aperture sizes of 300 μm and at least 50% by weight of the particles of the molybdenum oxide powder pass through a test sieve having nominal aperture sizes of 125 μm. More preferably at least 90% by weight of the particles of the molybdenum oxide powder pass through a test sieve having nominal aperture sizes of 125 μm and at least 50% by weight of the particles of the molybdenum oxide powder pass through a test sieve having nominal aperture sizes of 45 μm. Nominal aperture sizes in the present application are in accordance with ISO 565:1990 and which hereby is incorporated by reference.

In one embodiment at least 90% by weight, more preferably at least 99% by weight, of the particles of the molybdenum oxide powder pass through a test having nominal aperture sizes of 250 μm, more preferably 125 μm, most preferably 45 μm.

Iron Containing Powder

The iron powder is mainly used to strengthen the agglomerates (e.g. acts as a binder) but may also balance the desired amount of Fe and Mo in the final product. The iron containing powder is preferably an iron powder containing at least 80 wt % Fe, preferably at least 90 wt % Fe, more preferably at least 95 wt % Fe, most preferably at least 99 wt % Fe. The iron powder can be an iron sponge powder and/or a water atomised iron powder and/or a gas atomised iron powder and/or an iron filter dust and/or an iron sludge powder. For instance filter dust X-RFS40 from Höganäs AB, Sweden is a suitable powder.

The iron powder may partly or fully be replaced by an iron oxide powder, for instance but not limited to: powder consisting of one or more from the group of FeO, $Fe_2O_3$, $Fe_3O_4$, FeO(OH), ($Fe_2O_3$*$H_2O$). The iron oxide powder may e.g. be mill scale.

In one embodiment the iron containing powder contains at least 50% be weight of metallic iron, more preferably at least 80 wt % metallic Fe, most preferably at least 90 wt % metallic Fe Preferably at least 90% by weight of the particles of the iron containing powder pass through a test sieve having nominal aperture sizes of 125 μm and at least 50% by weight of the particles of the iron containing powder pass through a test sieve having nominal aperture sizes of 45 μm.

In one embodiment at least 90% by weight, more preferably at least 99% by weight, of the particles of the iron containing powder pass through a test sieve having nominal aperture sizes of 125 μm, more preferably 45 μm. In one example at least 90% by weight, more preferably at least 99% by weight, of the particles of the iron containing powder pass through a test sieve having nominal aperture sizes of 20 μm.

Carbonaceous Powder

The carbonaceous powder is preferably chosen from the group of: sub-bituminous coals, bituminous coals, lignite, anthracite, graphite, coke, petroleum coke, and bio-carbons such as charcoal, or carbon containing powders processed from these resources. The carbonaceous powder may e.g. be soot, carbon black, activated carbon. The carbonaceous powder can also be a mixture of different carbonaceous powders.

Regarding the choice of carbonaceous powder, the reactivity of the carbon may be taken into consideration, since the productivity as well as the yield of Mo depends on this factor. A high reactivity is desired. In particular, it is desirable to have a carbonaceous powder that is reactive at lower temperatures (preferably <700° C.). For instance German brown coal (lignite) is normally reactive at lower temperatures than petroleum coke, and is hence suitable since it has comparably high reactivity at low temperatures. Also charcoal, bituminous and sub-bituminous coals can exhibit comparably high reactivity. Particularly suitable examples are soot, carbon black, and activated carbon. Graphite may also be suitably due to its high density.

The amount of carbonaceous powder is preferably determined by analysing the amount of oxides in the molybdenum oxide powder and optionally the iron containing powder. Preferably the amount of reducible oxides is determined. The oxygen content can e.g. be analysed by a LECO® TC400. Furthermore the maximum allowed carbon content in the agglomerates is preferably also taken into consideration. Preferably the amount is chosen to stoichiometric match or slightly exceed the amount of reducible metal oxides in the molybdenum oxide powder and the iron containing powder. However, the amount of carbon may also be sub-stoichiometric.

The amount of carbonaceous powder can be optimised by measuring the carbon and the oxygen levels in the produced agglomerates (e.g. by producing agglomerates in a lab furnace and measuring carbon and oxygen levels). Based on the measurements the amount of carbonaceous powder can be optimised to achieve desired levels of carbon and oxygen in the produced agglomerates. Some oxides, which may be present in the molybdenum oxide powder are difficult to reduce with carbon. All oxides with higher affinity to oxygen at the reduction max temperature will remain as oxides in the finished product and therefore do not consume carbon in the reduction process. Such oxides can for instance be oxides of Si, Ca, Al, and Mg and may e.g. be present if cruder grades of molybdenum trioxide are used, e.g. technical molybdenum trioxide. However, in many applications of steel metallurgy these oxides can be handled e.g. by removing them in the slag of steel melt and they can therefore be allowed in the agglomerates. If lower amounts of these oxides and elements are desired, purer grades of molybdenum trioxide can be employed, e.g. grades that contain less or no amounts of these oxides.

By controlling the amount of carbonaceous powder and matching it with the amount of reducible oxides in the green agglomerates; the iron and molybdenum containing agglomerates can be made that has carbon content (after reduction) less than 1% by weight, preferably less than 0.5 wt %, more preferably less than 0.1 wt %, and most preferably less than 0.05 or even 0.01 wt %. Such agglomerates can e.g. be used when alloying low carbon steels.

However it is also possible to produce fully reduced agglomerates having carbon contents in the range of 1-10% by weight.

Preferably, at least 90% by weight, more preferably at least 99% by weight, of the particles of the carbonaceous powder pass through a test sieve having nominal aperture sizes of 125 μm, and at least 50% by weight of the particles of the carbonaceous powder pass through a test sieve having nominal aperture sizes of 45 μm.

In one embodiment at least 90% by weight, more preferably at least 99% by weight, of the particles of the carbonaceous powder pass through a test sieve having nominal aperture sizes of 45 μm, and at least 50% by weight of the particles of the carbonaceous powder pass through a test sieve having nominal aperture sizes of 20 μm. In one example at least 90% by weight, more preferably at least 99% by weight of the particles of the carbonaceous powder pass through a test sieve having nominal aperture sizes of 20 μm.

Iron and Molybdenum Containing Green Pellets

The green agglomerates in the form of green pellets will now be described

The iron and molybdenum containing green pellets have a dry matter composition in weight % of: 1-25 Fe, 15-40 O, 5-25 C, less than 15 of other elements besides O, C, Mo and Fe, and balance being at least 30 Mo. Dry matter composition refers to the composition for a dried specimen, i.e. excluding any moisture present in the green pellets.

Iron is preferably within the range of 1.5-20% by weight, more preferably 2-15% by weight, even more preferred 2-10% by weight.

Carbon is preferably 7-20% by weight.

Oxygen is preferably 15-30% by weight.

Molybdenum is preferably 40-65% by weight.

Other elements in the periodic table are preferably at least 1% by weight and less than 10% by weight, more preferably at least 2% by weight and less than 7% by weight. Other elements are preferably only present as impurities.

In subsequent reduction steps, the relative amount of iron and molybdenum will increase in the pellets as the reduction progresses.

Dried green pellets can reach compression strength in the range of 200-1 000 N/pellet, preferably 300-800 N/pellet.

The green pellets can be cost efficient substitutes to $MoO_3$ powder or standard FeMo when alloying in melting practices, considering price and/or yield of the Mo addition into melt. Typically, such addition could be made e.g. into electrical arc furnace (EAF) and e.g. be a Mo addition into stainless steel, tool steel or high speed steel.

The average diameter of the green pellets is preferably in the range of 3-35 mm, preferably 5-25 mm. Too large pellets may prolong the needed reduction time, while too small pellets can be difficult to handle.

The green pellets have a geometric density starting from 1.0 g/cm$^3$, preferably at least 1.2 g/cm$^3$. The density may also be limited to be at least 1.5 g/cm$^3$ or at least 2.0 g/cm$^3$. The geometric density is preferably less than 4.0 g/cm3. The geometric density may also be limited to be less than 3.5 g/cm$^3$, or less than 3.2 g/cm$^3$, or less than 3.0 g/cm$^3$, or less than 2.9 g/cm$^3$, or less than 2.8 g/cm$^3$. A lower geometric density results in higher porosity, which is believed to yield a shorter dissolution time of the pellets. The geometric (envelope) density can be measured in accordance to ASTM 962-08.

The shape of the green pellet is typically spherical, spheroidal, or ellipsoidal. When handled, this form compared to the form a compressed briquettes reduces the risk of shredding. Furthermore the flow properties are better than that of briquettes.

Reduced Iron and Molybdenum Containing Pellets

The reduced agglomerates in the form of reduced pellets will now be described.

The iron and molybdenum containing pellets that can be produced by the suggested process have a composition in weight % of: 2-30 Fe, less than 30 O, less than 20 C, less than 15 of other elements besides O, C, Mo and Fe, and balance being at least 40 Mo, preferably a least 50 Mo.

The molybdenum trioxide in the pellets may be partially reduced, e.g. a pellet that contains $MoO_x$, where $0.5<x<3$, preferably $1\leq x\leq 2.6$. When producing such pellets, the required amount of carbonaceous powder is less than the amount required to reduce all reducible oxides. Such pellets can thus be made by selecting the relative amount of carbonaceous powder to be sub stoichiometric.

However, a partially reduced pellet may be made to have remaining carbon in the pellets that can be activated later on to reduce the remaining reducible oxides, e.g. when the pellets are added to the steel melt. Such pellets can be made by controlling reduction temperature and duration, for instance by heat treating at 400-800° C. to partially reduce the pellets.

The partially reduced pellet is preferably reduced to contain less than 30% by weight of 0, more preferably less than 25% by weight of 0, typically around 10-20% by weight, and the remaining carbon content is preferably provided to be less than 15% by weight, more preferably 5-15% by weight. The molybdenum content of a partially reduced pellet is preferably at least 40% by weight, more preferably at least 50% by weight, most preferably at least 60% by weight.

For many applications, it is however preferred that the content of 0 is less than 10% by weight, more preferably less than 8% by weight, even more preferred less than 6% by weight, most preferably less than 4% by weight, and preferably that only a minority of the oxygen content comes from molybdenum oxide that has not been reduced, i.e. a pellet that contains $MoO_x$, where $x\leq 0.5$. Preferably essentially all of the molybdenum oxide is reduced to Mo, i.e. where x is around 0. Here, remaining oxygen content mainly comes from oxides in molybdenum oxide powder and the iron containing powder that are difficult to reduce, e.g. oxides of Si, Ca, Al, and Mg. Using purer grades of the molybdenum oxide powder, the iron containing powder, and the carbonaceous powder, the oxygen content of the pellets can, if desired, be made lower than 2% by weight. However, since many of these oxides that are difficult to reduce can be handled in the steel melt metallurgy (e.g. removing them in the slag phase), they may be allowed in the iron and molybdenum containing pellets. The lower limit for oxygen may be about 0% by weight, but typically the oxygen is at least 1% by weight, more typically at least 2% by weight.

The molybdenum content in the pellets can be controlled by varying the relative proportions of the molybdenum oxide powder in relation to the iron containing powder. For essentially fully reduced pellets (i.e. pellets containing MoOx where $x\leq 0.5$) the content of molybdenum is preferably controlled to be in the range of 60-95% by weight. More preferably the content of Mo is in the range of 65-95 wt %, most preferably the content of Mo is in the range of 70-95 wt %. Surprisingly a very high dissolution rate has been found for reduced pellets having a molybdenum content of 80-95% by weight. This result is due to the much higher specific surface and is in spite of the very high melting point of these alloys, 2100-2500° C.

By balancing the carbon addition it is possible to control the carbon content of the reduced pellets to be less than 5 wt. %, less than 2 wt. %, less than 0.5 wt. %, less than 0.1 wt. %, or less than 0.05 wt. %. Pellets low in carbon can e.g. be used when alloying low carbon steels. However, in some applications, for example in the production of high carbon steels or cast iron, it may desirable to have a carbon content in the range of 1-5% by weight.

The iron content of the pellets is preferably within the range of 2-25% by weight, more preferably 3-20% by weight. The iron content may also be limited to 4-15% by weight or 5-10% by weight. The iron content in the pellets can be controlled by varying the relative proportions of the iron containing powder in relation to the molybdenum oxide powder.

The reduced pellets can be cost efficient substitutes to $MoO_3$ powder or standard FeMo, when alloying in melting practices, considering price and/or yield of the Mo addition into melt. Typically such addition could be made e.g. into an electrical arc furnace (EAF) and e.g. be a Mo addition into stainless steel, tool steel or high speed steel.

Depending on the purity of the powder mixture, the pellets may contain further elements including oxides that are difficult to reduce. Other elements apart from Mo, Fe, C and O may be allowed up to less than 15% by weight. Preferably the total amount of other elements besides O, C, Mo and Fe is less than 10% by weight, more preferably less than 7% by weight. The amount of other elements is mainly controlled by the purity of the molybdenum trioxide, but may also come from impurities in the iron containing powder, the carbonaceous powder, and from reactions with elements in the surrounding atmosphere during heating, reduction, or cooling. Using high purity grades of molybdenum trioxide, iron containing powder and the carbonaceous powder; the total amount of other elements besides O, C, Mo and Fe can, if desired, be kept lower than 1% by weight. If present in the pellets, elements from the group of Si, Ca, Al, and Mg are mainly bound as oxides. For instance, in a steel melt, silicon bound as silicon oxides may be easier to handle than silicon that is dissolved in the lattice of the alloy. The other elements may in some embodiments be limited to at least 1% by weight or to at least 2% by weight. Preferably the other elements are only present as impurities.

Preferably, in some embodiments, the other elements in weight % are limited to:

max 2 N, more preferably max 1 N;
max 1 S, more preferably max 0.5 S;
max 2 Al, more preferably max 1.5 Al;
max 2 Mg, more preferably max 1 Mg;
max 2 Na, more preferably max 1 Na;
max 4 Ca, more preferably max 2 Ca;
max 6 Si, more preferably max 3 Si;
max 1 K, more preferably max 0.5 K;
max 1 Cu, more preferably max 0.5 Cu;
max 1 Pb, more preferably max 0.1 Pb;
max 1 W, more preferably max 0.1 W;
max 1 V, more preferably max 0.1 V;

and remaining elements is preferably max 0.5 each, more preferably max 0.1 each, most preferably max 0.05 each.

In some embodiment, the content in weight % of Si is in the range of 0.5-3, the content of Ca is in the range of 0.3-2, the content of Al is in the range 0.1-1, and/or the content of Mg is in the range of 0.1-1.

Preferably, if present, the elements of the group of Si, Ca, Al and Mg are to at least to 50% by weight bound as oxides in the pellets, preferably at least to 90% by weight.

The nitrogen content mainly depends on the nitrogen level in the atmosphere during heating, reduction and cooling of the pellets. By controlling the atmosphere in these steps the nitrogen content can be made lower than 0.5 wt %, preferably lower than 0.1 wt % and most preferably lower than 0.05 wt %.

The average diameter of the pellets is preferably in the range of 3-30 mm, preferably 5-20 mm. Too large pellets may prolong the needed reduction time, while too small pellets can be difficult to handle.

The pellets have a geometric density starting from 1.0 g/cm$^3$, preferably at least 1.2 g/cm$^3$. The density may also be limited to be at least 1.5 g/cm$^3$ or at least 2.0 g/cm$^3$. The geometric density is preferably less than 4.0 g/cm3. The geometric density may also be limited to be less than 3.5 g/cm$^3$, or less than 3.2 g/cm$^3$, or less than 3.0 g/cm$^3$, or less than 2.9 g/cm$^3$, or less than 2.8 g/cm$^3$. A lower density results in higher porosity, which is believed to yield a shorter dissolution time of the pellets. The density is measured in accordance with ASTM 962-08.

The apparent density (as determined by helium pycnometry) of the pellets is preferably in the range of 5-10 g/cm$^3$. The apparent density may also be limited to be in the range of 6-8 g/cm$^3$.

The bulk density of the pellets (as determined by filling a can having a volume of 1 liter with pellets and weighing it) is preferably within the range of 0.5-3 g/cm$^3$, more preferably 1.0-2.0 g/cm$^3$.

Open porosity (as determined by mercury intrusion porosimeter at 4.45 psia) is preferably within the range of 0.1-0.6 cm$^3$/g. The open porosity may also be limited to be in the range of 0.2-0.45 cm$^3$/g.

Preferably the median open pore diameter (as determined by mercury intrusion porosimeter at 4.45 psia) is in the range of 0.5-20 μm. The median open pore diameter may also be limited to be in the range of 2-10 μm, or in the range of 3-6 μm.

Preferably at 20-95% of the pore volume (as determined by mercury intrusion porosimeter at 4.45 psia) comes from pores within the range of 1-10 μm, more preferably at least 50%, most preferably at least 70%.

Open porosity (as determined by mercury intrusion porosimeter at 4.45 psia) is preferably within the range of 50-80 vol %.

BET surface area is preferably in the range of 0.1-10 m2/g. The BET value may also be limited to 0.4-4 m2/g, or 0.6-2 m2/g, or 0.8-1.5 m2/g.

The pellets preferably have compression strength in the range of 200-1000 N/pellet. The compression strength may also be limited to be in the range of 300-800 N/pellet.

The shape of the pellet is typically spherical, spheroidal, or ellipsoidal. When handled, this form compared to the form of a compressed briquette reduces the risk of shredding, which typically has sharp edges. Furthermore the flow properties are better than that of briquettes. Furthermore they can be produced at lower costs since a briquetting step is not required.

In some applications it may be desirable to have other shapes than spherical, spheroidal, or ellipsoidal. For instance pellets that are transported on a conveyor belt may roll of the belt depending on how the conveyor belt is configured.

Pellet agglomerates comprising 2-300 pellets are less likely to roll off a conveyor belt. The pellets may be agglomerated by means of a binding agent such as glue. Preferably such agglomerates contain 2-20 pellets, more preferably 5-15 pellets.

It is also possible to form pellets agglomerates by filling plastic bags with pellets, and preferably hot shrinking the plastic around the pellets and/or vacuum shrinking. Preferably such agglomerates contain 30-300 pellets, more preferably 50-200 pellets, most preferably 75-150 pellets.

Another way to avoid the problem is to fill a container, such as a metal canister, with pellets. Preferably the container has an inner volume in the range of 100-125000 cm$^3$.

Of course, also the green pellets may be agglomerated or put in containers in the manner described above.

The pellets may further be hot briquetted at a temperature in the range of 250-1000° C., preferably 400-800° C., and more preferably between two counterrotating rollers, most preferably at a pressing force in the range of 60-200 kN per cm active roller width. Suitable hot briquetting machines are for instance sold by Maschinenfabrik Köppern GmbH & Co. A binder may optionally be added in the hot briquetting step. The volume of a briquette is preferably between 15 and 200 cm$^3$. Of course, also the green pellets may be hot briquetted. The briquettes have a geometric density in the range of 3.0-8.0 g/cm$^3$, preferably 4.0-6.0 g/cm$^3$.

Iron and Molybdenum Containing Green Compacts

The agglomerates may be compacts. The compacts may be: briquettes, filter cakes, flakes or other compacted agglomerates.

The iron and molybdenum containing green compacts may have a dry matter composition in weight-% of:

| | |
|---|---|
| 1-25 | iron containing powder; |
| 5-30 | carbonaceous powder; |
| Optionally | |
| 0.1-10 | lubricant and/or binder and/or slag former; and |
| balance 50-90 | molybdenum oxide powder. |

Dry matter composition refers to the composition for a dried specimen, i.e. excluding any moisture present in the green compacts.

According to one embodiment the iron and molybdenum containing green compacts having a dry matter composition in weight-% of:

| | |
|---|---|
| 1-15, preferably 1-10 | iron containing powder, |
| 5-25, preferably 10-20 | carbonaceous powder, |
| Optionally | |
| 0.1-10 | lubricant and/or binder and/or slag former; and |
| balance at least 50-90 | molybdenum oxide powder. |

In one embodiment the dry matter composition of the green compacts consists of in weight-%:

| | |
|---|---|
| 1-15, preferably 1-10 | iron containing powder, |
| 5-25, preferably 10-20 | carbonaceous powder, |
| balance 50-90 | molybdenum oxide powder. |

In regards to elements the iron and molybdenum containing green compacts preferably have a dry matter composition in weight % of: 1-25 Fe, 15-40 O, 5-25 C, less than 15 of other elements besides O, C, Mo and Fe, and balance being at least 30 Mo. Preferably the dry matter composition in weight % is: 1-15 Fe, 15-40 O, 5-25 C, less than 15 of other elements besides O, C, Mo and Fe, and balance being at least 30 Mo.

The elements may further be limited to:

Iron is preferably within the range of 1.5-10% by weight.

Carbon is preferably 7-20% by weight.

Oxygen is preferably 15-30% by weight.

Molybdenum is preferably 40-65% by weight.

Other elements are preferably at least 1% by weight and less than 10% by weight, more preferably at least 2% by weight and less than 7% by weight. Other elements are preferably only present as impurities.

In subsequent reduction steps, the relative amount of iron and molybdenum will increase in the compacts as the reduction progresses. The same may of course true for the other elements that remain.

The green compacts can be cost efficient substitutes to $MoO_3$ powder or standard FeMo when alloying in melting practices, considering price and/or yield of the Mo addition into melt. Typically, such addition could be made e.g. into electrical arc furnace (EAF) and e.g. be a Mo addition into stainless steel, tool steel or high speed steel.

The green compacts may have a geometric density up to 5 g/cm$^3$ or even up to 6 g/cm$^3$. Preferably the geometric density is in the range of 1.0-4.0 g/cm$^3$. In other embodiments the geometric density may be in the range of 1.2-3.5 g/cm$^3$, or 1.2-3.0 g/cm$^3$. The geometric density may be less than 4 g/cm$^3$. Density can be increased by increasing compacting pressure. A lower geometric density results in higher porosity, which is believed to yield a shorter dissolution time of the compacts. The geometric (envelope) density can be measured in accordance to ASTM 962-08.

Reduced Iron and Molybdenum Containing Compacts

The iron and molybdenum containing compacts may have a composition in weight % of: 1-30 Fe, less than 30 O, less than 20 C, less than 15 of other elements besides O, C, Mo and Fe, and balance being at least 40 Mo, preferably a least 50 Mo.

Suitably, the reduced iron and molybdenum containing compacts have a composition in weight % of: 1-20 Fe, less than 10 O, less than 10 C, less than 15 of other elements besides O, C, Mo and Fe, and balance being at least 40 Mo, preferably a least 50 Mo.

Preferably the content of O is less than 10% by weight, more preferably less than 8% by weight, even more preferred less than 6% by weight, most preferably less than 4% by weight, and preferably that only a minority of the oxygen content comes from molybdenum oxide that has not been reduced, i.e. a compact that contains $MoO_x$, where $x \leq 0.5$. Preferably essentially all of the molybdenum oxide is reduced to Mo, i.e. where x is around 0. Here, remaining oxygen content mainly comes from oxides in molybdenum oxide powder and the iron containing powder that are difficult to reduce, e.g. oxides of Si, Ca, Al, and Mg. Using purer grades of the molybdenum oxide powder, the iron containing powder, and the carbonaceous powder, the oxygen content of the compacts can, if desired, be made lower than 2% by weight. However, since many of these oxides that are difficult to reduce can be handled in the steel melt metallurgy (e.g. removing them in the slag phase), they may be allowed in the iron and molybdenum containing compact. The lower limit for oxygen may be about 0% by weight, but typically the oxygen is at least 1% by weight, more typically at least 2% by weight.

The molybdenum content in the compacts can be controlled by varying the relative proportions of the molybdenum oxide powder in relation to the iron containing powder. For essentially fully reduced compacts (i.e. compacts containing $MoO_x$ where $x \leq 0.5$) the content of molybdenum is preferably controlled to be in the range of 60-95% by weight. More preferably the content of Mo is in the range of 65-95 wt %, most preferably the content of Mo is in the range of 70-95 wt %. Surprisingly a very high dissolution rate has been found for reduced compacts having a molybdenum content of 80-95% by weight. This result is due to the much higher specific surface and is in spite of the very high melting point of these alloys, 2100-2500° C.

By balancing the carbon addition it is possible to control the carbon content of the reduced compacts to be less than 5 wt %, less than 2 wt. %, less than 1 wt. %, less than 0.5 wt. %, or less than 0.1 wt. %. Compacts low in carbon can e.g. be used when alloying low carbon steels. However, in some applications, for example in the production of high carbon steels or cast iron, it may desirable to have a carbon content in the range of 1-5% by weight.

The iron content of the compacts is preferably within the range of 1-20% by weight, more preferably 2-10% by weight, most preferably 2-5% by weight. The iron content in the compacts can be controlled by varying the relative proportions of the iron containing powder in relation to the molybdenum oxide powder.

The reduced compacts can be cost efficient substitutes to $MoO_3$ powder or standard FeMo, when alloying in melting practices, considering price and/or yield of the Mo addition into melt. Typically such addition could be made e.g. into an electrical arc furnace (EAF) and e.g. be a Mo addition into stainless steel, tool steel or high speed steel.

Depending on the purity of the powder mixture, the compacts may contain further elements including oxides that are difficult to reduce. Other elements apart from Mo, Fe, C and O may be allowed up to less than 15% by weight. Preferably the total amount of other elements besides O, C, Mo and Fe is less than 10% by weight, more preferably less than 7% by weight. The amount of other elements is mainly controlled by the purity of the molybdenum trioxide, but may also come from impurities in the iron containing powder, the carbonaceous powder, and from reactions with elements in the surrounding atmosphere during heating, reduction, or cooling. Using high purity grades of molybdenum trioxide, iron containing powder and the carbonaceous powder; the total amount of other elements besides O, C, Mo and Fe can, if desired, be kept lower than 1% by weight. If present in the compacts, elements from the group of Si, Ca, Al, and Mg are mainly bound as oxides. For instance, in a steel melt, silicon bound as silicon oxides may be easier to handle than silicon that is dissolved in the lattice of the alloy. The other elements may in some embodiments be limited to at least 1% by weight or to at least 2% by weight. Other elements include impurities.

Preferably, in some embodiments, the other elements in weight % are limited to:

max 2 N, more preferably max 1 N;

max 1 S, more preferably max 0.5 S;

max 2 Al, more preferably max 1.5 Al;

max 2 Mg, more preferably max 1 Mg;

max 2 Na, more preferably max 1 Na;

max 4 Ca, more preferably max 2 Ca;

max 6 Si, more preferably max 3 Si;

max 1 K, more preferably max 0.5 K;

max 1 Cu, more preferably max 0.5 Cu;

max 1 Pb, more preferably max 0.1 Pb;

max 1 W, more preferably max 0.1 W;

max 1 V, more preferably max 0.1 V;

and remaining elements is preferably max 0.5 each, more preferably max 0.1 each, most preferably max 0.05 each.

In some embodiment, the content in weight % of Si is in the range of 0.5-3, the content of Ca is in the range of 0.3-2, the content of Al is in the range 0.1-1, and/or the content of Mg is in the range of 0.1-1.

Preferably, if present, the elements of the group of Si, Ca, Al and Mg are to at least to 50% by weight bound as oxides in the compacts, preferably at least to 90% by weight.

The nitrogen content mainly depends on the nitrogen level in the atmosphere during reduction and cooling of the compacts. By controlling the atmosphere in these steps the nitrogen content can be made lower than 0.5 wt %, preferably lower than 0.1 wt % and most preferably lower than 0.05 wt %.

Reduced compacts may be produced with a geometric density up to 6 g/cm$^3$, preferably less than 4.5 g/cm$^3$. It may be less than 4.0 g/cm$^3$. For quick dissolving in steel melt it is preferred that the reduced compacts have a geometric density in the range of 1.0-4.0 g/cm$^3$. Other possible ranges includes 1.2-3.5 g/cm$^3$, 1.2-3.0 g/cm$^3$, 1.5-3.9 g/cm$^3$ and 2.0-4.0 g/cm$^3$. The given upper and lower limits of the ranges may be combined with one another to form new ranges. Density can be controlled by varying the briquetting pressure for the green compacts. A higher reduction temperature may also increase density. By controlling process parameters it is possible to produce reduced compacts having geometric density below 2.0 g/cm$^3$ as well as reduced compacts having geometric density between 2.0-4.0 g/cm$^3$, or even higher up to 6 g/cm$^3$.

A lower density results in higher porosity, which is believed to yield a shorter dissolution time of the compacts. On the other hand a higher density increases the amount of Mo for a given volume. The geometric density measured in accordance with ASTM 962-08.

Example 1

A mixture was prepared by mixing 3% by weight of a fine grained iron powder (<40 μm, >99 wt % Fe, X-RSF40 from Höganäs AB) with 84% by weight of a technical grade molybdenum oxide (Mo>57 wt. %, <40 μm) and 13% by weight of a carbon powder (<20 μm, Carbon Black). Water was added to the mixture and green pellets were produced in a disc pelletizer. The pellets had a moisture content of about 10% by weight as measured using by LOD in accordance to ASTM D2216-10. The pellets were thereafter dried at room temperature to a moisture of 2 wt %.

The green pellets were reduced in a batch furnace at a temperature of 1100° C. for a time period of 2 hours, in a 95 vol-% $N_2$ and 5 vol-% $H_2$ atmosphere. The pellets were thereafter allowed to cool to a temperature around 100° C. before evacuating the atmosphere and removal from the furnace. The result was pellets having a weight around 0.4 gram and a diameter around 6-7 mm. The average geometric density of the pellets was determined to be 2.6 g/cm$^3$ as measured according to ASTM 962-08.

The pellets were ground to powder and the chemical composition of the powder was determined. The results are presented in table 1.

The oxygen content of the pellets mainly comes from oxides that are difficult to reduce e.g. oxides of Mg, Al, Si and Ca. Such oxides can be present in the technical grade molybdenum trioxide and are hard to reduce. Therefore, by using purer grades of molybdenum trioxide the oxygen content can made considerably lower. However, in many applications these oxides can be allowed in the pellets, because they are rapidly separated to the slag.

TABLE 1 chemical composition of FeMo pellets

| Mo | Fe | C | S | O | N | |
|---|---|---|---|---|---|---|
| 82.5 | 8.12 | 0.02 | 0.04 | 3.37 | 0.63 | |
| Mg | Al | Si | K | Ca | Cu | Rem. |
| 0.25 | 0.55 | 2.40 | 0.26 | 1.10 | 0.29 | 0.47 |

Example 2

FIG. 1 shows the dissolving rate for a standard reference grade of solid ferromolybdenum compared to the iron and molybdenum containing pellets of the invention, i.e. a novel ferromolybdenum grade. Pellets from the same batch as of example 1 were provided and hence having the composition as of table 1. As described in example 1 the average geometric density of the pellets was determined to be 2.6 g/cm$^3$.

The reference material was 10 lumps of standard ferromolybdenum containing 70% by weight of molybdenum, not more than 2% impurities and the balance being iron. The size of each lump was around 10×50 mm.

The aim with the experiment was to evaluate if the iron and molybdenum containing pellets had a faster dissolution time than standard ferromolybdenum.

Two steel melts, a first and a second, were prepared and their compositions were analyzed. The target compositions of the melts were 5.0 wt. % Mo, 0.6 wt. % C, balance Fe and the content of Mo was originally 0 wt % in both steel melts. The steel melts were both held at a temperature around 1550° C. during the experiment. To the first melt Mo was added in the form of the iron and molybdenum containing pellets consistent with those described herein in Example 1, and to the second steel melt the lumps of the reference grade were added. The pellets and the reference grade were added in one batch respectively to their corresponding steel melts. A test sample was taken every 30 second from each steel melt to measure the Mo-content therein. Ten test samples were taken for each melt, and FIG. 1 shows how the content of Mo changes over time for each melt. As can be seen the content of Mo increases much quicker for the steel melt being alloyed by the pellets than for that of the steel melt being alloyed by the reference grade of standard ferromolybdenum.

Example 3

A mixture A was prepared by mixing 2.5% by weight of a fine grained iron powder (<40 μm, >99 wt % Fe, X-RSF40 from Höganäs AB) with 84% by weight of a technical grade molybdenum oxide (Mo>57 wt. %, <40 μm) and 13.5% by weight of a carbon powder (<20 μm, Carbon Black). Water was added to the mixture and green pellets were produced in a disc pelletizer. After pelletizing, the green pellets were dried for 2 hours at a temperature of 90° C. reducing the moisture to below 2 wt %.

The dried green pellets were reduced in a rotary furnace at a temperature of 1120° C. for a time period of 0.5 hours. A weakly reducing gas 95 vol-% $N_2$ and 5 vol-% $H_2$ atmosphere was supplied counter flow during reduction. The pellets were thereafter allowed to cool to a temperature around 100° C. under protective atmosphere. The result was pellets having a weight around 1.9 grams and a diameter around 12 mm.

Two pellets were examined in a mercury intrusion porosimeter pressure was 4.45 psia (instrument: Micromeritics AutoPore III 9410). The analysis was done in the pore size range: 330 μm≥Ø≥0.003 μm. The results are presented in table 2. Here it can be seen that the total open pore volume was measured to 0.32 $cm^3/g$ and the median open pore diameter to 4 μm. The open porosity was determined to 68 vol %, and that the pore area to 0.7 $m^2/g$. These data shows that the pellets have a fine porous structure that can promote the dissolution rate in steel melt. The geometric (envelope) density was determined to 2.1 $g/cm^3$. The skeletal (apparent) density was determined to 6.56 $g/cm^3$ with the mercury intrusion porosimeter. The skeletal (apparent) density was also determined by helium pycnometry to 7.36 $g/cm^3$ (instrument: AccuPyc 1330, Micromeritics).

BET surface area was determined to 0.98 m2/g (instrument: Gemini 2360, Micromeritics).

TABLE 2

| mercury intrusion data | | | | | | |
|---|---|---|---|---|---|---|
| Mixture | Pore volume [$cm^3/g$] | Porosity [vol %]* | Pore diameter, [μm] | Pore area, [$m^2/g$]* | Geometric density, [$g/cm^3$]* | Skeletal density, [$g/cm^3$]* |
| A | 0.32 | 68 | 4 | 0.7 | 2.10 | 6.56 |

*Calculated values from Micromeritics AutoPore III 9410

Figure 3:
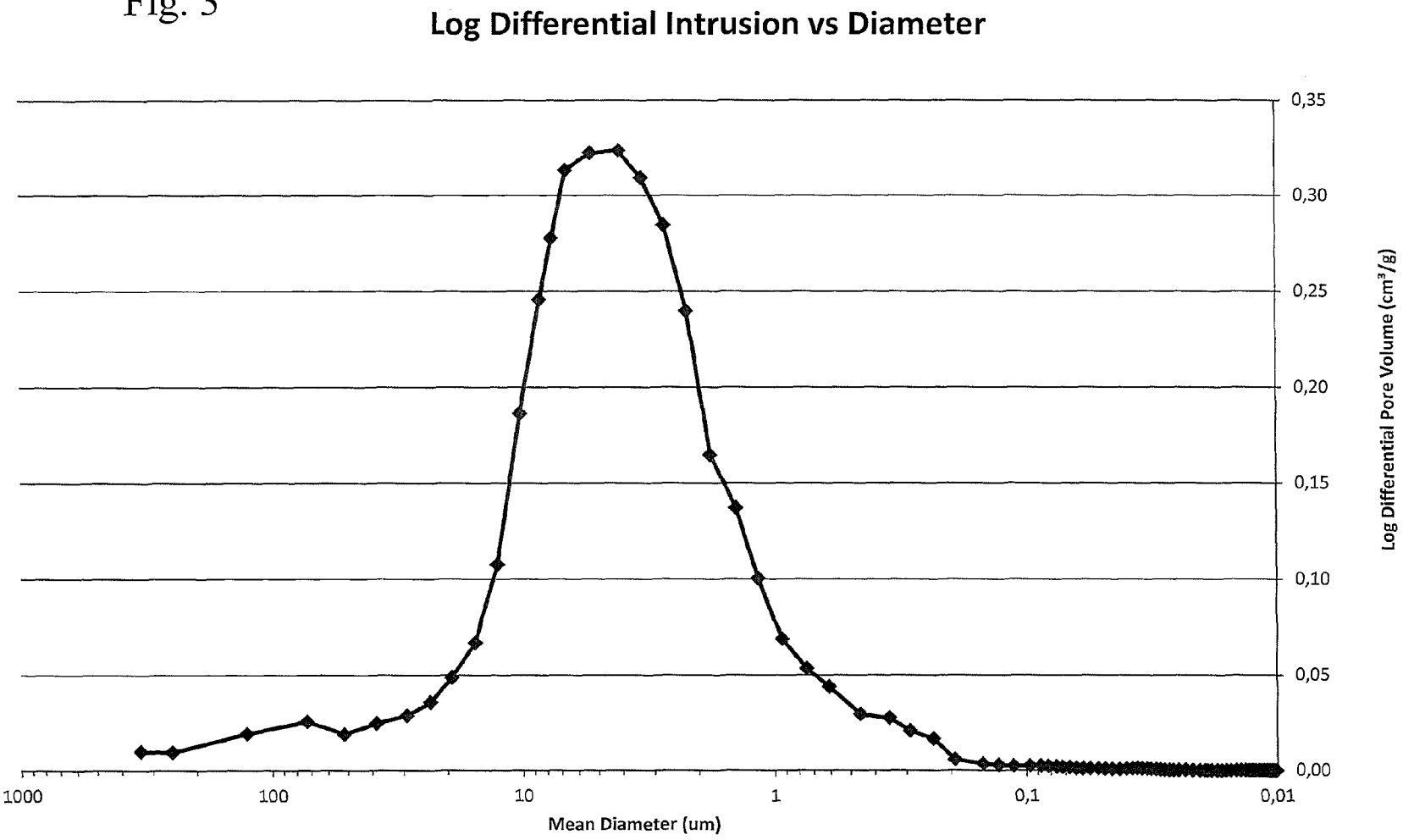
FIG. 3 shows the Logarithmic Differential Intrusion plotted versus the pore diameter of an iron and molybdenum containing pellet.
Figure 4:
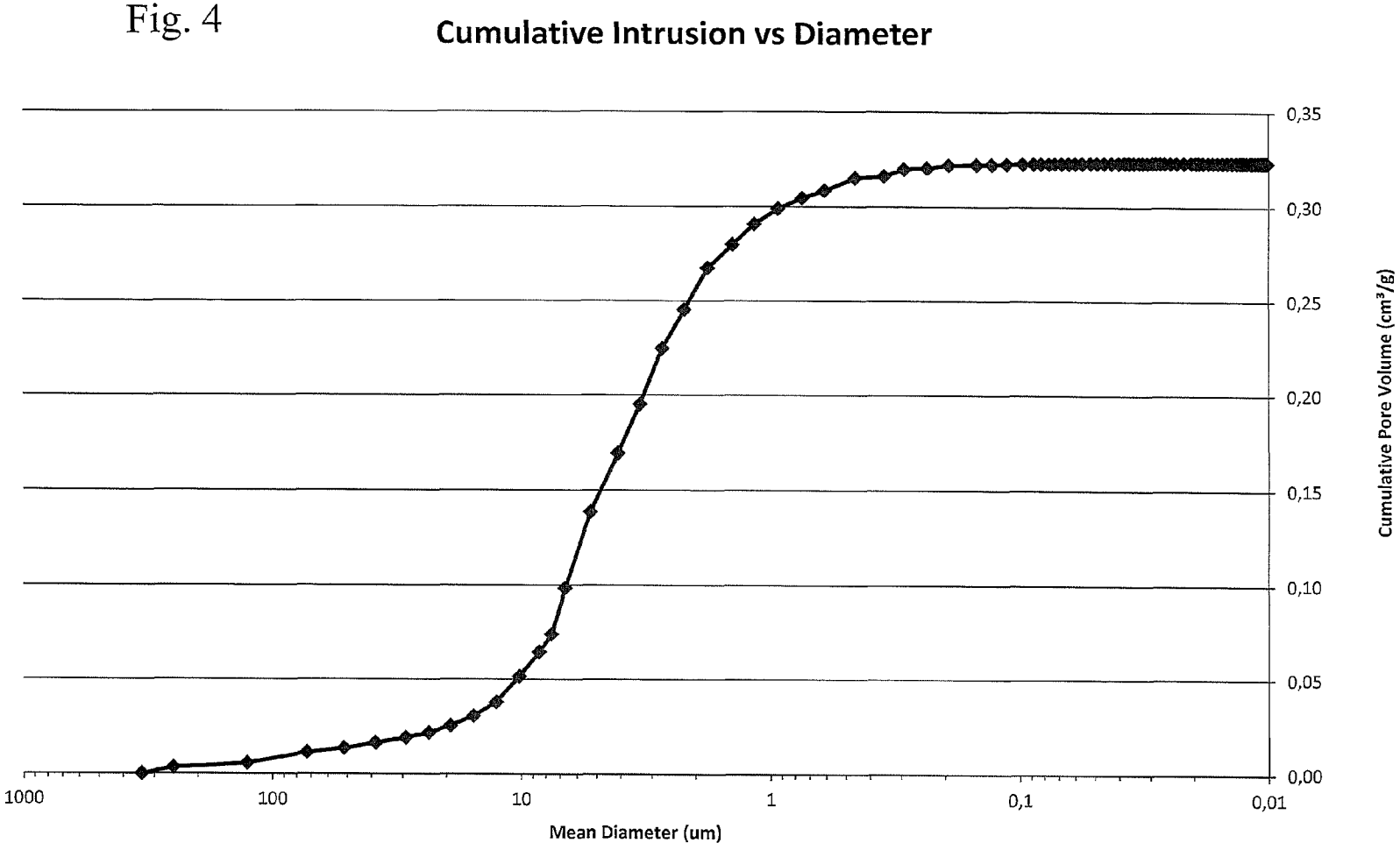
FIG. 4 shows the cumulative intrusion is plotted versus pore diameter of an iron and molybdenum containing pellet.

In FIG. 3 the Logarithmic Differential Intrusion is plotted versus the pore diameter. As can be seen in the figure most of the pores have a pore diameter between 1-10 μm forming a narrow band around the median pore diameter 4 μm. In FIG. 4 the cumulative intrusion is plotted versus pore diameter. From the figure it is evident that more than 70% of the pore volume comes from pores within the range of 1-10 μm.

The bulk density of the pellets was determined by filling a can having a volume of 1 liter with pellets and weighing it, resulting in a value for the bulk density of 1.5 $g/cm^3$.

The size and the shape of the pellets provide a comparably large macro surface area for a plurality of pellets, i.e. the outer surfaces of the pellets. In addition the pellets gave a comparably large open porosity and a pore structure that provide a comparably large inner micro surface area. The large micro surface area and the large macro surface area in combination promote high dissolution rate and minimizes sublimation losses of Mo when e.g. being added as an alloying additive to a steel melt.

Example 4

The compression strength of the green pellets from mixture A of Example 3 was examined and compared to the compression strength of green pellets made from a mixture B. Mixture B was prepared by mixing 84% by weight of a technical grade molybdenum oxide (Mo>57 wt. %, <40 μm) and 13.5% by weight of a carbon powder (<20 μm, Carbon Black). I.e. the essential difference between mixture A and B was that B did not contain iron powder. The powders were wet mixed and the wet mixture was thereafter transferred to a disc pelletizer where green pellets were produced. The compression strength was determined by increasing the load on a pellet until it is crushed. 1 hour after being removed from the pelletizer the green pellets from mixture A had a compression strength of 50 N/pellet, while the green pellets from mixture B had a compression strength of 37 N/pellet.

After being dried in a ventilated dryer for 2 hours at a temperature of 90° C., the average compression strength of the dried green pellets from mixture A was determined to 530 N/pellet, while the average compression strength of the dried green pellets from mixture A was determined to 155 N/pellet. This shows that the iron addition considerably increased the compression strength of the dried green pellets.

Example 5

A mixture was prepared by mixing 180 g of a fine grained iron powder (<40 μm, >99 wt % Fe, X-RSF40 from Höganäs AB) with 1000 g molybdenum oxide (MoO3 92.5 wt %, SiO2 7.5 wt %, <40 μm) and 176 g graphite powder (<40 μm). 7 dl of Water was added to the mixture. The mixture was compacted in a briquetting machine using a compaction pressure of 75 kg/cm2. Ten green briquettes were thereafter dried at room temperature to a moisture of 0.5 wt %.

The green briquettes was visually examined and handled. No identification of cracking was observed. The green briquettes were reduced in a batch furnace at a temperature of 1300° C. for a time period of 20 minutes, in a 95 vol-% $N_2$ and 5 vol-% $H_2$ atmosphere.

The reduced briquettes were thereafter allowed to cool to a temperature around 100° C. before evacuating the atmosphere and removal from the furnace. The reduced was visually examined. No identification of cracking was observed.

The invention claimed is:

1. Iron and molybdenum containing green agglomerates having a dry matter composition in weight-% of:
- 1-25 Fe,
- 15-40 O,
- 5-25 C,
- less than 15 of other elements, and
- balance at least 30 Mo,
- wherein the agglomerates contains in weight %: 1-15 Fe, and
- wherein the geometric density is in a range of 1.0 $g/cm^3$ to 4.0 $g/cm^3$.

2. Green agglomerates according to claim 1 wherein the agglomerates are selected from the group consisting of pellets, briquettes, filter cakes, and sheets.

3. Iron and molybdenum containing green agglomerates having a dry matter composition in weight-% of:
- 1-25 Fe,
- 15-40 O,
- 5-25 C,
- less than 15 of other elements, and
- balance at least 30 Mo,
- wherein the geometric density is in a range of 1.0 $g/cm^3$ to 4.0 $g/cm^3$.

4. Green agglomerates according to claim 3 wherein the agglomerates are selected from the group consisting of pellets, briquettes, filter cakes, and sheets.

5. Reduced iron and molybdenum containing agglomerates having a geometric density less than 4.0 $g/cm^3$ and having a composition in weight % of:
- 1-30 Fe;
- less than 30 O;
- less than 20 C;
- less than 15 of other elements; and
- balance at least 40 Mo.

6. Reduced iron and molybdenum containing agglomerates according to claim 5, wherein the agglomerates contains in weight %: 2-25 Fe.

7. Reduced iron and molybdenum containing agglomerates according to claim 5, wherein the agglomerates contain in weight %: less than 10 of other elements.

8. Reduced iron and molybdenum containing agglomerates according to claim 5, wherein the agglomerates contain in weight %: at least 1 of other elements.

9. Reduced iron and molybdenum containing agglomerates according to claim 5, wherein the agglomerates contain in weight %: at least 60 Mo.

10. Reduced iron and molybdenum containing agglomerates according to claim 5, wherein the agglomerates contain in weight %: less than 10 O.

11. Reduced iron and molybdenum containing agglomerates according to claim 5, wherein the agglomerates contain in weight %: less than 5 C.

12. Reduced iron and molybdenum containing agglomerates according to claim 5, wherein the agglomerates contain in weight %: 80-95 Mo.

13. Reduced iron and molybdenum containing agglomerates according to claim 5, wherein the agglomerates having a composition in weight % of:

2-10 Fe;

less than 10 O;

less than 5 C;

less than 10 of other elements; and balance at least 70 Mo.

14. Reduced iron and molybdenum containing agglomerates according to claim 5, wherein the agglomerates having a composition in weight % of:

2-10 Fe;

less than 4 O;

less than 0.5 C;

less than 7 of other elements; and balance 80-95 Mo.

15. Reduced iron and molybdenum containing agglomerates according to claim 5, wherein the geometric density is in a range of 1.0 $g/cm^3$ to 4.0 $g/cm^3$.

16. Reduced iron and molybdenum containing agglomerates according to claim 5, wherein the balance of the composition in weight % of the agglomerates is least 50 Mo.

17. Reduced iron and molybdenum containing agglomerates according to claim 5 wherein the agglomerates are selected from the group consisting of pellets, briquettes, filter cakes, and sheets.

* * * * *